US011211691B2

(12) United States Patent
Kuo et al.

(10) Patent No.: US 11,211,691 B2
(45) Date of Patent: Dec. 28, 2021

(54) ANTENNA STRUCTURE AND WIRELESS COMMUNICATION DEVICE WITH SAME

(71) Applicant: Chiun Mai Communication Systems, Inc., New Taipei (TW)

(72) Inventors: Wen-Yi Kuo, New Taipei (TW); Po-Ching Huang, New Taipei (TW); Chueh-Chuan Chen, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 166 days.

(21) Appl. No.: 16/441,226

(22) Filed: Jun. 14, 2019

(65) Prior Publication Data

US 2019/0386379 A1 Dec. 19, 2019

(30) Foreign Application Priority Data

Jun. 14, 2018 (CN) ..... 201810615100.3

(51) Int. Cl.

| | |
|---|---|
| ***H01Q 1/24*** | (2006.01) |
| ***H01Q 1/36*** | (2006.01) |
| ***H01Q 5/357*** | (2015.01) |
| ***H01Q 9/30*** | (2006.01) |
| ***H01Q 5/328*** | (2015.01) |
| ***H01Q 9/04*** | (2006.01) |
| ***H01Q 21/30*** | (2006.01) |
| ***H01Q 5/335*** | (2015.01) |
| ***H01Q 21/28*** | (2006.01) |
| ***H01Q 5/371*** | (2015.01) |

(52) U.S. Cl.

CPC ..... *H01Q 1/243* (2013.01); *H01Q 1/36* (2013.01); *H01Q 5/328* (2015.01); *H01Q 5/335* (2015.01); *H01Q 5/357* (2015.01); *H01Q 5/371* (2015.01); *H01Q 9/0407* (2013.01); *H01Q 9/30* (2013.01); *H01Q 21/28* (2013.01); *H01Q 21/30* (2013.01)

(58) Field of Classification Search

CPC ..... H01Q 1/243; H01Q 1/36; H01Q 1/48; H01Q 5/328; H01Q 5/335; H01Q 5/357; H01Q 5/364; H01Q 5/371; H01Q 5/40; H01Q 5/50; H01Q 9/0407; H01Q 9/30; H01Q 9/0421

See application file for complete search history.

(56) References Cited

U.S. PATENT DOCUMENTS

2011/0241949 A1 10/2011 Nickel et al.
2017/0048363 A1* 2/2017 Lee ..... H01Q 1/521

FOREIGN PATENT DOCUMENTS

| | | |
|---|---|---|
| CN | 105514604 | 4/2016 |
| CN | 205583123 | 9/2016 |
| CN | 106848567 | 6/2017 |

(Continued)

*Primary Examiner* — Robert Karacsony
(74) *Attorney, Agent, or Firm* — ScienBiziP, P.C.

(57) ABSTRACT

An antenna structure able to occupy a very small space in an electronic device includes a metal frame and at least one feed source. The metal frame is metallic, a protruding portion protrudes from a side of the metal frame. The side of the metal frame with the protruding portion defines a first gap and a second gap. The first gap and the second gap divide the metal frame into radiation portions. The at least one feed source is electrically connected to each of the at least two radiation portions and feeds a current to each of the at least two radiation portions.

8 Claims, 13 Drawing Sheets

(56) References Cited

FOREIGN PATENT DOCUMENTS

| | | |
|---|---|---|
| CN | 107039766 | 8/2017 |
| CN | 206532881 | 9/2017 |
| CN | 207354360 | 5/2018 |

* cited by examiner

ANTENNA STRUCTURE AND WIRELESS COMMUNICATION DEVICE WITH SAME

FIELD

The subject matter herein generally relates to wireless communication devices with antenna structures.

BACKGROUND

Electronic devices, such as mobile phones, personal digital assistants, can implement full-screen displays. However, constraints such as optical modules or other electronic components, screens of a particular shape may prevent the electronic devices from displaying the full-screen display. In addition, a clearance area of an antenna of the electronic device in the full-screen display should not be compressed. Therefore, there is room for improvement within the art.

BRIEF DESCRIPTION OF THE DRAWINGS

Implementations of the present technology will now be described, by way of embodiments, with reference to the attached figures.

DETAILED DESCRIPTION

Figure 1:
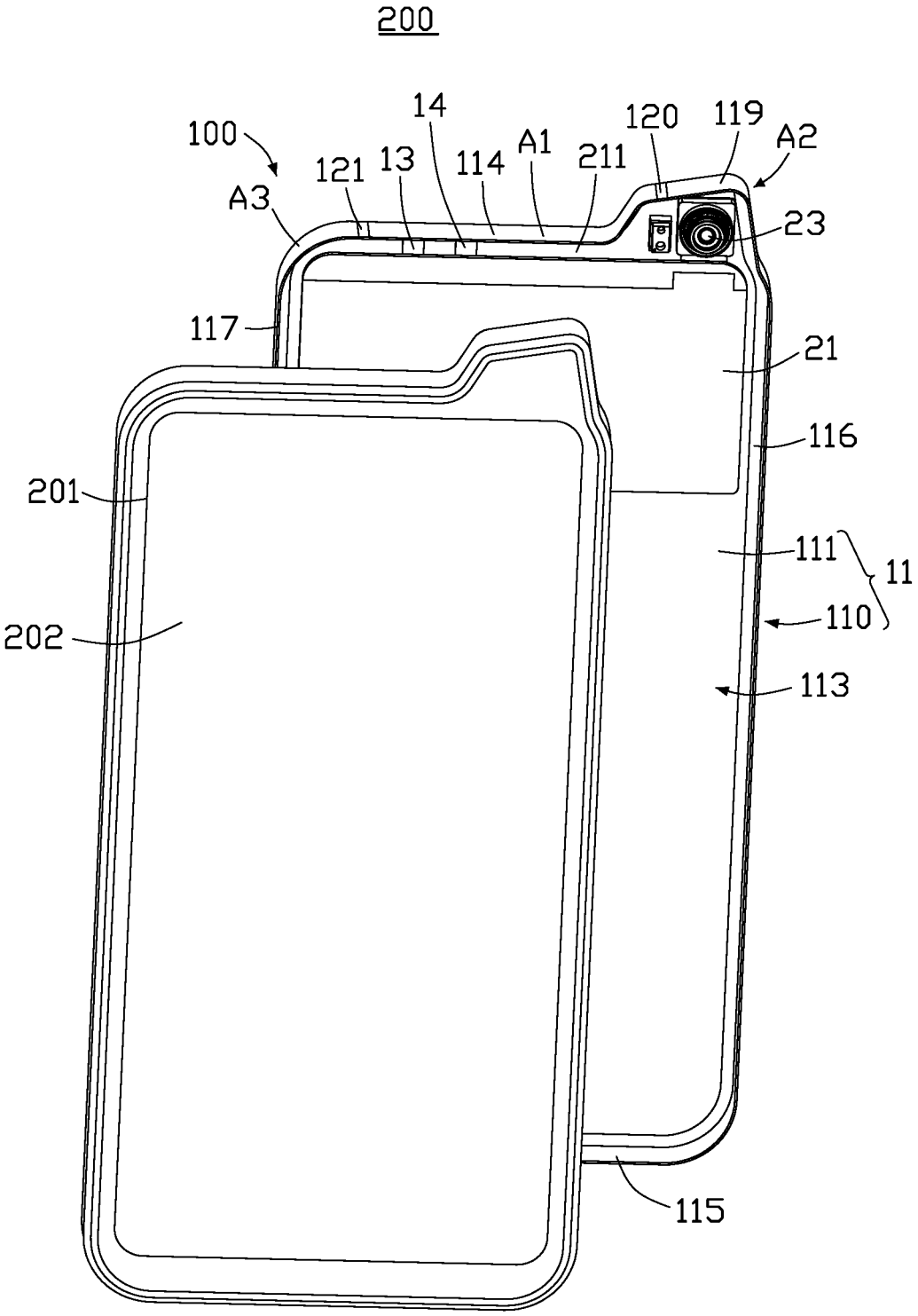
FIG. 1 is a partially exploded isometric view of an antenna structure in a wireless communication device according to a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to show details and features of the present disclosure better. The disclosure is by way of embodiments and not by way of limitation in the figures of the accompanying drawings, in which like references indicate similar elements. It should be noted that references to "an" or "one" embodiment in this disclosure are not necessarily to the same embodiment, and such references mean "at least one."

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like. The references "a plurality of" and "a number of" mean "at least two."

Figure 2:
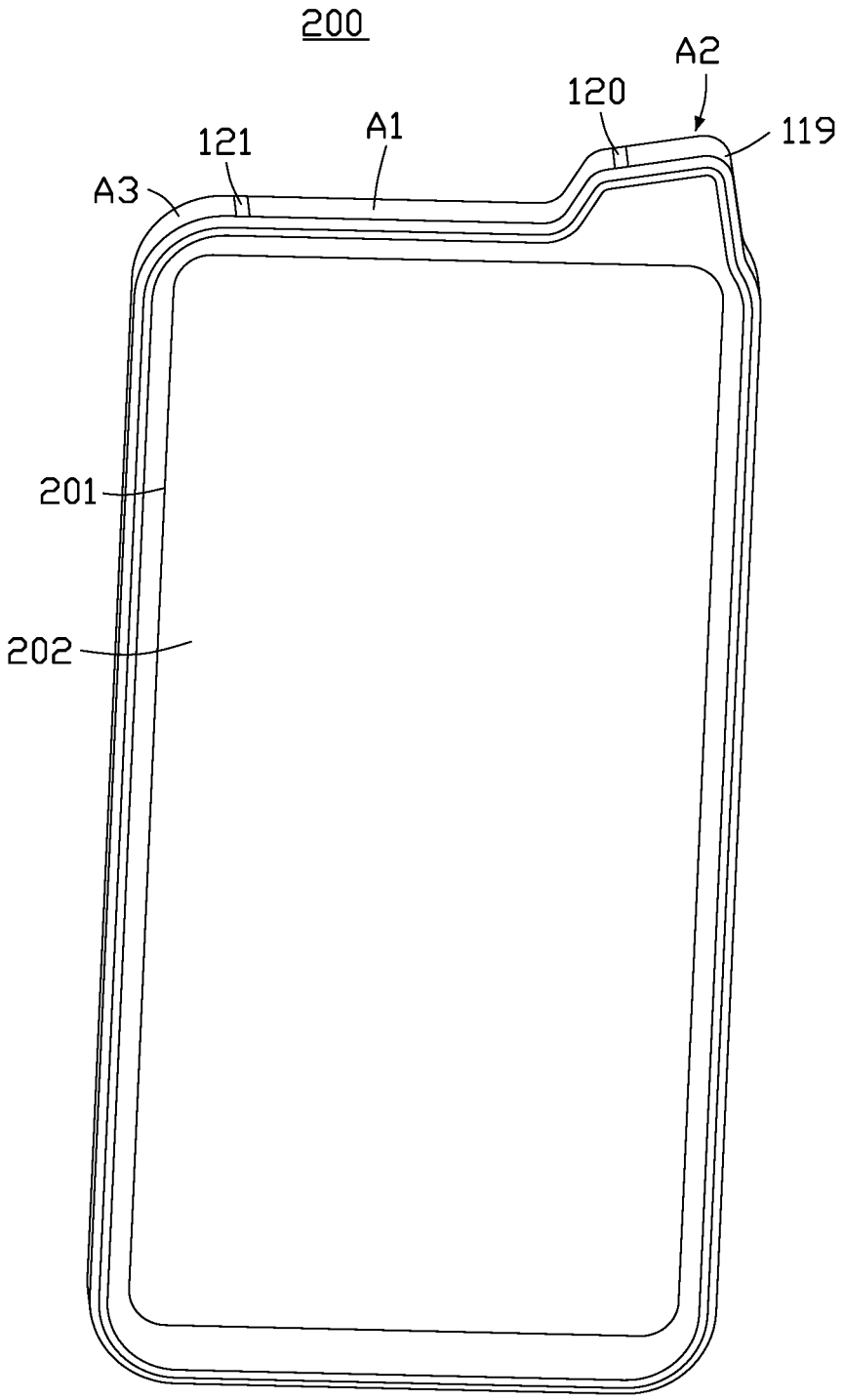
FIG. 2 is a front schematic view of the wireless communication device in FIG. 1.
Figure 3:
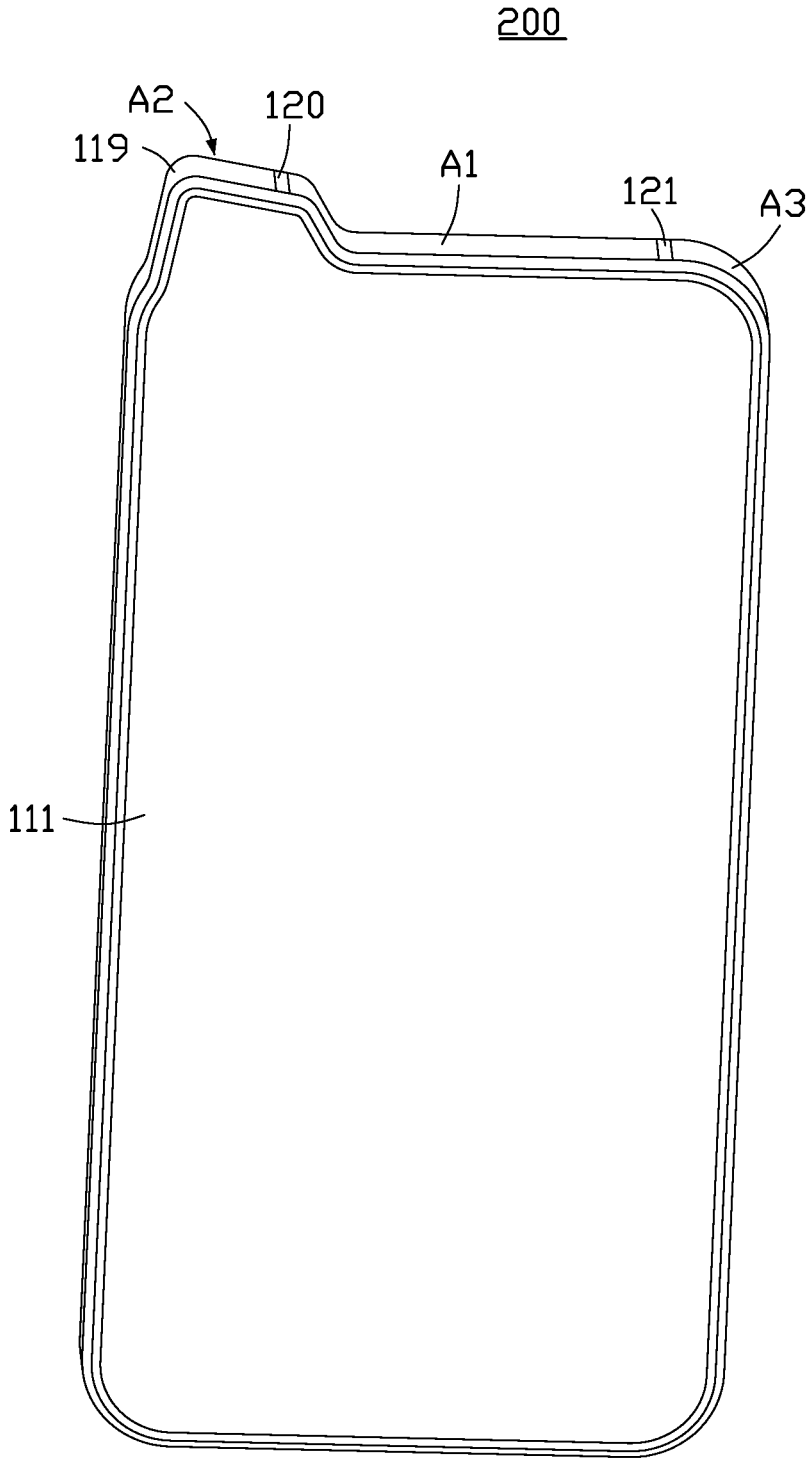
FIG. 3 is a rear schematic view of the wireless communication device in FIG. 1.

Referring to FIGS. 1-3, an antenna structure 100 is disclosed according to a first embodiment. The antenna structure 100 is adapted for a wireless communication device 200, for example a mobile phone or a personal digital assistant, for transmitting and receiving radio waves.

The antenna structure 100 at least includes a housing 11, a first feed source 12 (shown in FIG. 4), a connecting portion 13, and a ground portion 14. The housing 11 can be a shell of the wireless communication device 200. The housing 11 at least includes a metal frame 110 and a back plate 111. The metal frame 110 is annular and is made of a metallic material. A side of the metal frame 110 defines an opening (not labeled) for accommodating a display unit 201 of the wireless communication device 200. The display unit 201 includes a complete and uninterrupted display plane 202. The display plane 202 is exposed to the opening.

The backing plate 111 is made of a non-metallic material such as plastic, ceramic, or glass. The back plate 111 is disposed at an edge of the metal frame 110. The back plate 111 is parallel with the display plane 202. The back plate 111 and the metal frame 110 together define an accommodating space 113. The accommodating space 113 is configured to accommodate an electronic component or a circuit.

The metal frame 110 at least includes a first end portion 114, a first side portion 116, a second end portion 115, and a second side portion 117, connected in sequence. The first end portion 114 is opposite to the second end portion 115, the first side portion 116 is opposite to the second side portion 117. In the embodiment, the first end portion 114 is a top end of the wireless communication device 200. The second end portion 115 is a bottom end of the wireless communication device 200. The first end portion 114 is disposed opposite to the second end portion 115. The first side portion 116 is disposed opposite to the second side portion 117. The first side portion 116 and the second side portion 117 are disposed at two ends of the first end portion 114 and the second end portion 115. In an embodiment, the first side portion 116 is vertical to the second side portion 117. The first end portion 114, the second end portion 115, the first side portion 116 and the second side portion 117 are all connected to the back plate 111 and the display unit 201.

A protruding portion 119 protrudes on the metal frame 110. The metal frame 110 defines a first gap 120 and a second gap 121. In the embodiment, the protruding portion 119 is disposed on a side of the first end portion 114 adjacent to the first side portion 116 and extends in a direction away from the second end portion 115. The first gap 120 and the second gap 121 are both disposed at the first end portion 114. The first gap 120 is disposed on the protruding portion 119. The second gap 121 is disposed on a side of the first end portion 114 adjacent to the second side portion 117, spaced apart from the first gap 120. The first gap 120 and the second gap 121 divide the metal frame 110 into a first radiation portion A1, a second radiation portion A2, and a third radiation portion A3. The first radiation portion A1 is positioned between the first gap 120 and the second gap 121. A part of the metal frame 110 extending from the first gap 120 to the first side portion 116, that is, a portion of the protruding portion 119, forms the second radiation portion A2. A portion of the metal frame 110 extending from the second gap 121 to the second side portion 117 forms the third radiation portion A3. In the embodiment as disclosed, the protruding portion 119 constitutes a radiation portion of the antenna structure 100.

In the embodiment as disclosed above, the first gap 120 and the second gap 121 are filled with an insulating material (such as plastic, rubber, glass, wood, ceramic, etc., but not limited thereto).

In the embodiment, a size of the wireless communication device 200 is approximately 70 mm*148.5 mm*8 mm. The wireless communication device 200 further includes a substrate 21 and an electronic component 23. The substrate 21 is a printed circuit board (PCB), which can be made of a dielectric material such as epoxy glass fiber (FR4). The substrate 21 is disposed in the accommodating space 113. One end of the substrate 21 is spaced apart from the first end portion 114 to form a clearance area 211 between the substrate 21 and the first end portion 114.

In the embodiment, the electronic component 23 is an optical module. The electronic component 23 is disposed in the protruding portion 119 and is electrically connected to the substrate 21. It can be understood that, in the embodiment, the optical module can include at least one of a camera module, a fill light LED, a light sensor, and a proximity sensor.

Figure 4:
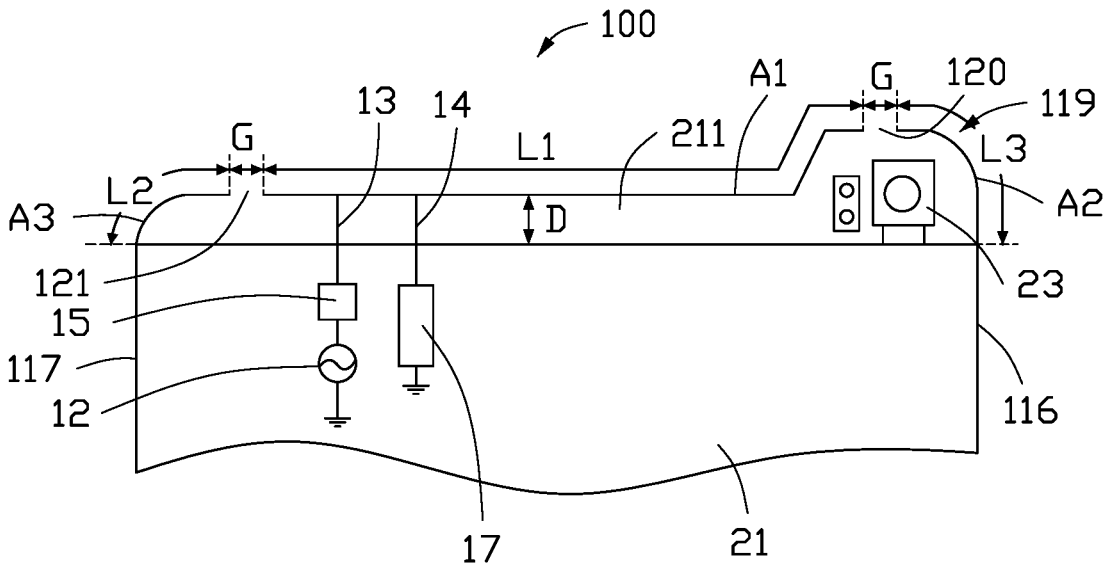
FIG. 4 is a circuit diagram of the antenna structure in FIG. 1.

Referring to FIG. 4, a width of the first gap 120 is G. A width of the second gap 121 is also G. A length of a part of the metal frame 110 between the first gap 120 and the second gap 121 is L1. A distance between the second gap 121 and the second side portion 117 is L2. The length between the first gap 120 and the first side portion 116 is L3. A distance between the first end portion 114 at the protruding portion 119 and the substrate 21 is D. In an embodiment, G is 1.5 mm, L1 is 43.7 mm, L2 is 14.7 mm, L3 is 22.2 mm, and D is 3.2 mm.

In the embodiment, the first feed source 12 and the connecting portion 13 are disposed in the accommodating space 113. One end of the first feed source 12 is electrically connected to a side of the first radiation portion A1 adjacent to the second gap 121 through the connecting portion 13, and the other end of the first feed source 12 is grounded for feeding current to the first radiation portion A1.

The ground portion 14 is disposed in the accommodating space 113 and located at a side of the first feed source 12 away from the second gap 121. The ground portion 14 is spaced apart from the first feed source 12. One end of the ground portion 14 is electrically connected to the first radiation portion A1. The other end of the ground portion 14 is grounded, for portion A1.

Figure 5:
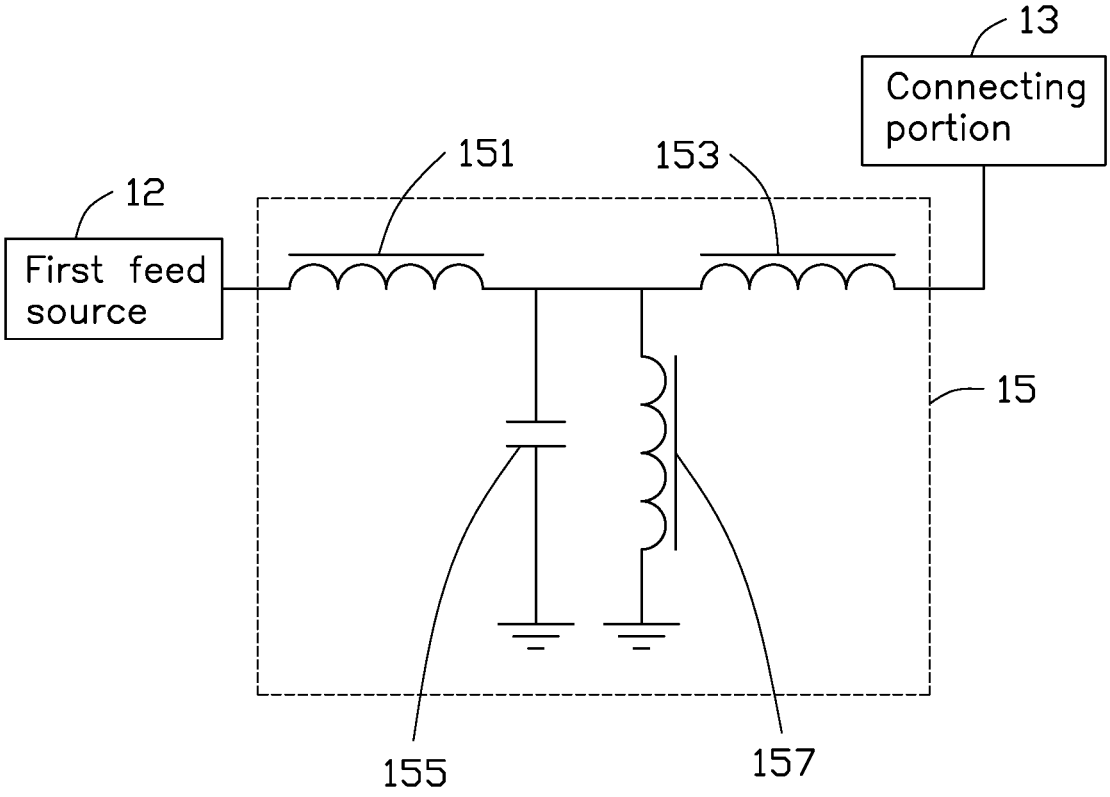
FIG. 5 is a circuit diagram of a circuit matched for the antenna structure in FIG. 4.

Referring to FIG. 4 and FIG. 5, the antenna structure 100 further includes a matching circuit 15. The matching circuit 15 is disposed on the substrate 21. One end of the matching circuit 15 is electrically connected to the first feed source 12. The other end of the matching circuit 15 is electrically connected to the connecting portion 13 for optimizing impedance matching of the first feed source 12 and the first radiation portion A1.

In the embodiment, the matching circuit 15 includes a first matching element 151, a second matching element 153, a third matching element 155, and a fourth matching element 157. The first matching element 151 and the second matching element 153 are connected in series between the first feed source 12 and the connecting portion 13. One end of the third matching element 155 is electrically connected between the first matching element 151 and the second matching element 153. The other end of the third matching element 155 is grounded. One end of the fourth matching element 157 is electrically connected between the first matching element 151 and the second matching element 153. The other end of the fourth matching element 157 is grounded. That is, the third matching element 155 is disposed in parallel with the fourth matching element 157. One end of the third matching element 155 and one end of the fourth matching element 157 are electrically connected between the first matching element 151 and the second matching element 153, and the other end of the third matching element 155 and the other end of the fourth matching element 157 are grounded.

In the embodiment, each of the first matching element 151, the second matching element 153, and the fourth matching element 157 is an inductor. The third matching element 155 is a capacitor. The inductance values of the first matching element 151, the second matching element 153, and the fourth matching element 157 are respectively 2 nH, 1 nH, and 3.9 nH. The capacitance value of the third matching element 155 is 2.4 pF. The first matching element 151, the second matching element 153, the third matching element 155, and the fourth matching element 157 are not limited to being capacitor and inductor as described above, and may be other inductor, capacitor, or a combination thereof.

Figure 6:
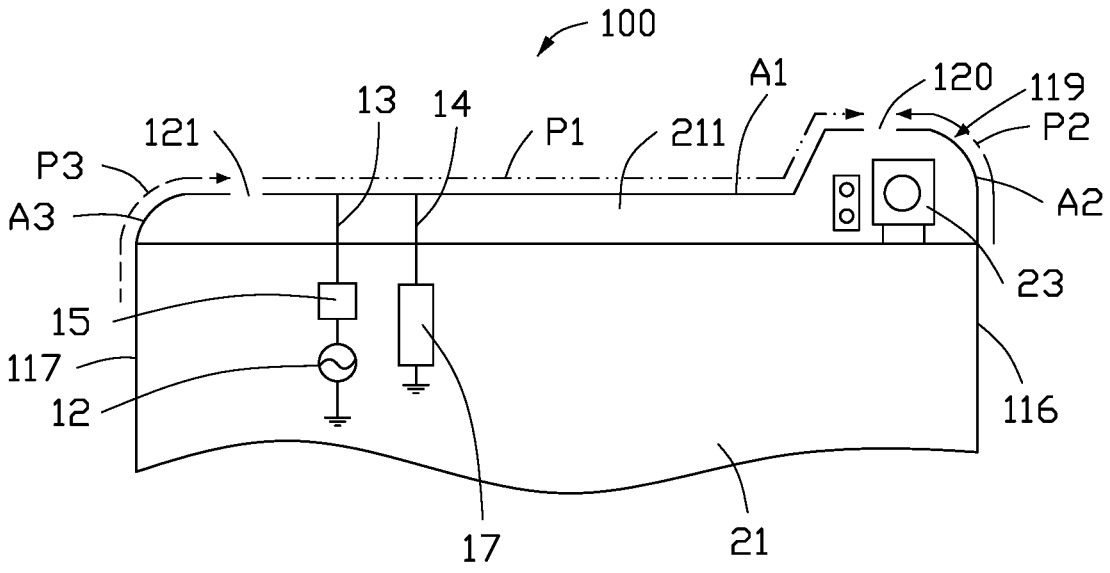
FIG. 6 is a schematic diagram of current flows of the antenna structure in FIG. 4.

Referring to FIG. 6, when a current is fed from the first feed source 12, the current is directly fed to the first radiation portion A1 through the matching circuit 15 and the connecting portion 13, and flows to the first gap 120. Thus, the first feed source 12, the ground portion 14 and the first radiation portion A1 together form an inverted F-type antenna to excite a first working mode. In this mode, radiation signal of a first radiation band (refer to path P1) is generated. At the same time, the current flowing through the first radiation portion A1 also couples to the second radiation portion A2 through the first gap 120. Thereby, the second radiation portion A2 is excited into a second working mode, to generate radiation signal of a second radiation band (refer to path P2). Furthermore, the current flowing through the first radiation portion A1 also couples to the third radiation portion A3 through the second gap 121 to cause the third radiation portion A3 to be excited into a third working mode, to generate radiation signal of a third radiation band (see path P3).

In the embodiment, the first working mode is an LTE-Advanced (LTE-A) low-frequency mode. The second working mode is an LTE-A intermediate frequency and high-frequency mode. The third working mode is an LTE-A high frequency mode. The first radiation band is 700-960 MHz. The second radiation band is 1430-2170 MHz and 2500-2690 MHz. The third radiation band is 2300-2400 MHz.

Figure 7:
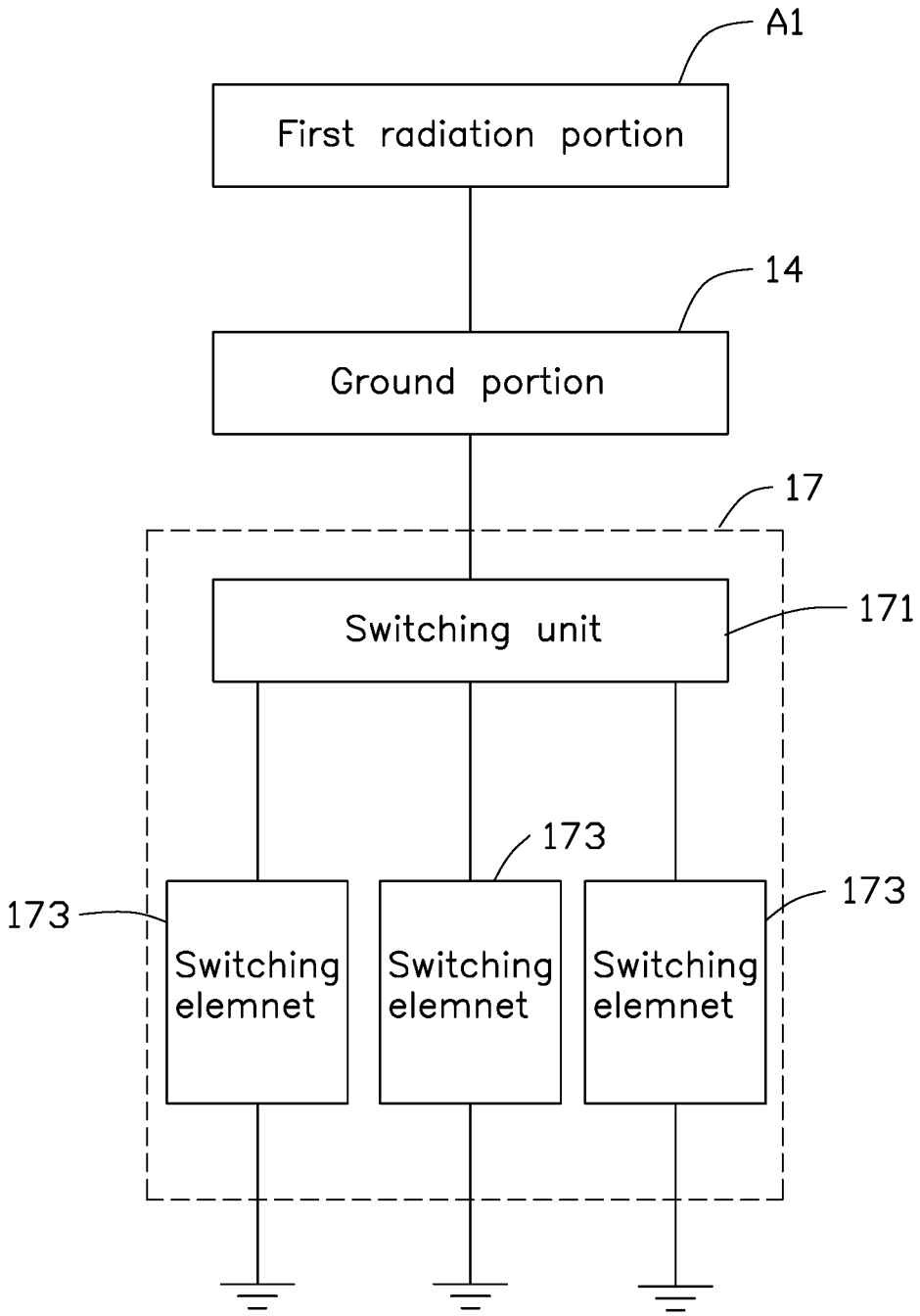
FIG. 7 is a circuit diagram of a switching circuit in the antenna structure in FIG. 4.

Referring to FIG. 4 and FIG. 7, in the embodiment, the antenna structure 100 further includes a switching circuit 17. One end of the switching circuit 17 is electrically connected to the ground portion 14, and electrically connected to the first radiation portion A1 through the ground portion 14. The other end of the switching circuit 17 is grounded. The switching circuit 17 includes a switching unit 171 and a number of switching elements 173. The switching unit 171 is electrically connected to the ground portion 14 to be electrically connected to the first radiation portion A1 through the ground portion 14. The switching elements 173 can be inductors, capacitors, or combinations of inductors and capacitors. The switching elements 173 are connected in parallel with each other. One end of each of the switching elements 173 is electrically connected to the switching unit 171, and the other end of each of the switching elements 173 is grounded.

By controlling the switching of the switching unit 171, the first radiation portion A1 can be switched to a different switching element 173. Since each of the switching elements 173 has a different impedance, the frequency of the first radiation band of the first working mode can be effectively adjusted by the switching of the switching unit 171. In the embodiment disclosed herein, the switching circuit 17 includes three switching elements 173 each having a different impedance: an inductance of 20 nH, an inductance of 40 nH, and an open circuit without any components, i.e., a floating state. By switching the first radiation portion A1 to each of the three different switching elements 173, the first radiation band of the first working mode in the antenna structure 100 can be made to cover 700-960 MHz.

Figure 8:
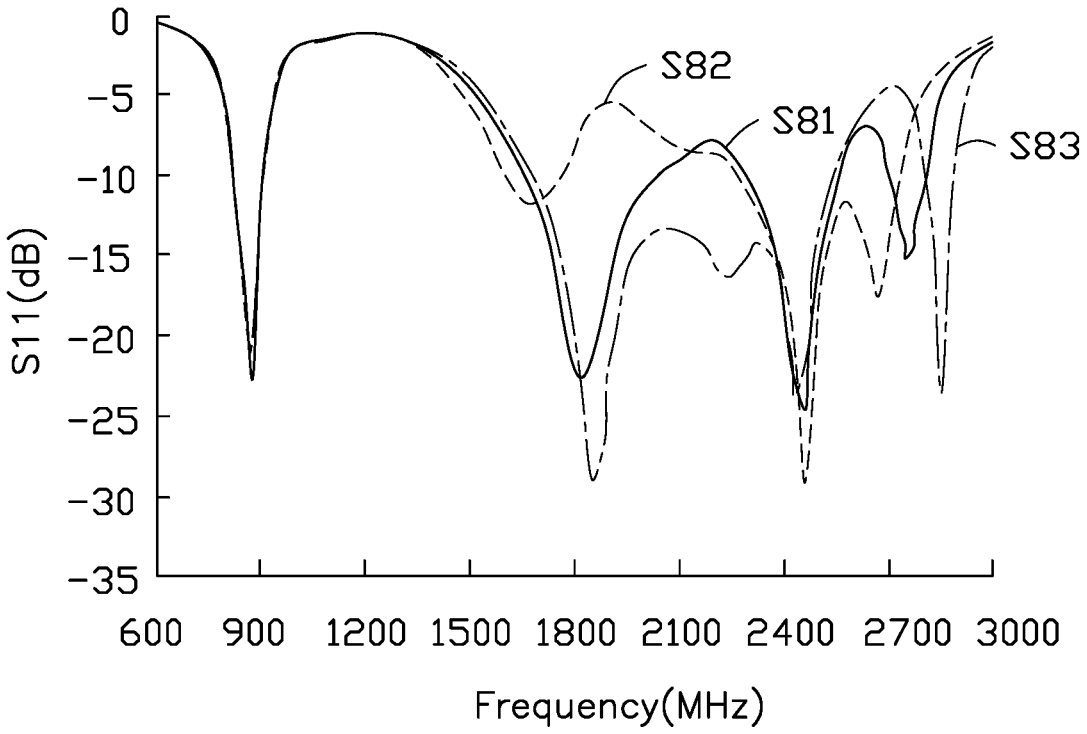
FIG. 8 is a graph of a scattering parameter S of the antenna structure in FIG. 4 when a length between a first gap and a first side portion of the antenna structure in FIG. 4 is adjusted.

FIG. 8 is a graph of a scattering parameter S of the antenna structure 100 in FIG. 4 when a length L3 between a first gap 120 and a first side portion 116 in FIG. 4 is adjusted. A curve S81 indicates value of the scattering parameter S11 when the length L3 between the first gap 120 and the first side portion 116 is 22.2 mm. The curve S82 indicates value of the scattering parameter S11 when the length L3 between the first gap 120 and the first side portion 116 is 24.2 mm. The curve S83 indicates value of the scattering parameter S11 when the length L3 between the first gap 120 and the first side portion 116 is 20.2 mm.

Figure 9:
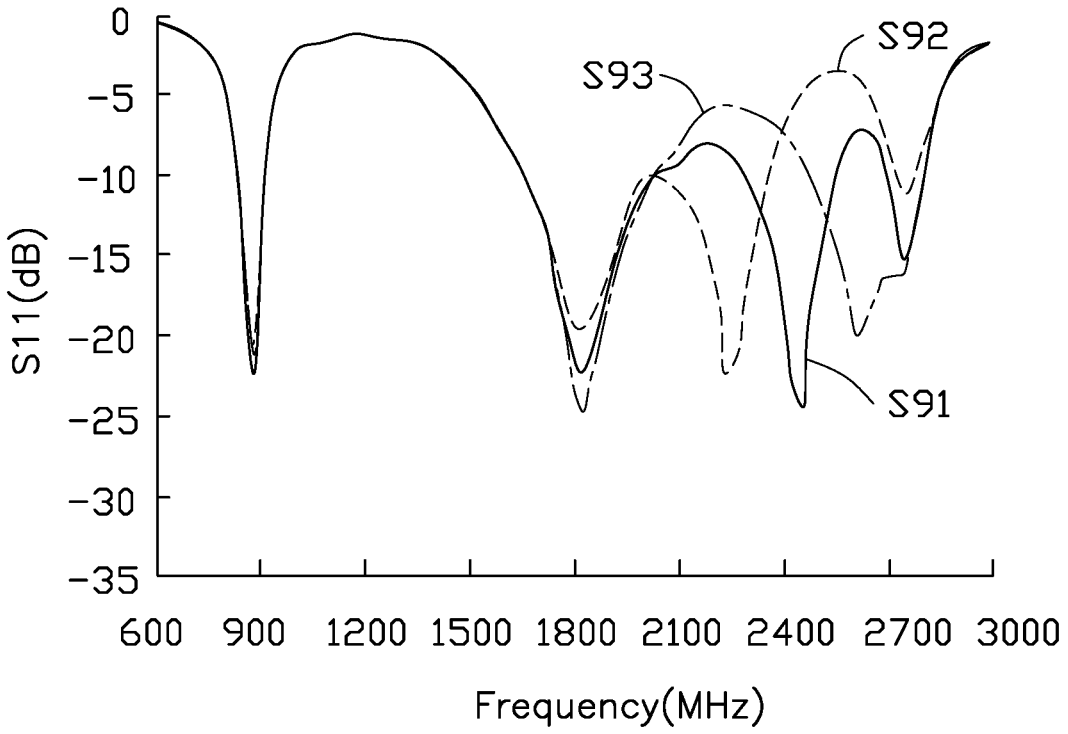
FIG. 9 is a graph of a scattering parameter S of the antenna structure in FIG. 4 when a length between a second gap and a second side portion of the antenna structure in FIG. 4 is adjusted.

FIG. 9 a graph of a scattering parameter S of the antenna structure in FIG. 4 when length between a second gap 121 and a second side portion 117 of the antenna structure in FIG. 4 is adjusted. The curve S91 indicates value of the scattering parameter S11 when the length L2 between the second gap 121 and the second side portion 117 is 14.7 mm. The curve S92 indicates value of the scattering parameter S11 when the length L2 between the second gap 121 and the second side portion 117 is 16.7 mm. The curve S93 indicates value of the scattering parameter S11 when the length L2 between the second gap 121 and the second side portion 117 is 12.7 mm.

FIGS. 8 and 9 indicate that the distance L3 between the first gap 120 and the first side portion 116 mainly affects the frequency of the second radiation band. The length L2 between the second gap 121 and the second side portion 117 mainly affects the frequency of the third radiation band. Furthermore, the intermediate frequency and high frequency of the antenna structure 100 can cover 1430-2690 MHz, and the value of the scattering parameter S11 is −5 dB. The antenna structure 100 has good efficiency, and its radiation efficiency is greater than −5 dB, which satisfies design requirements of an antenna.

Figure 10:
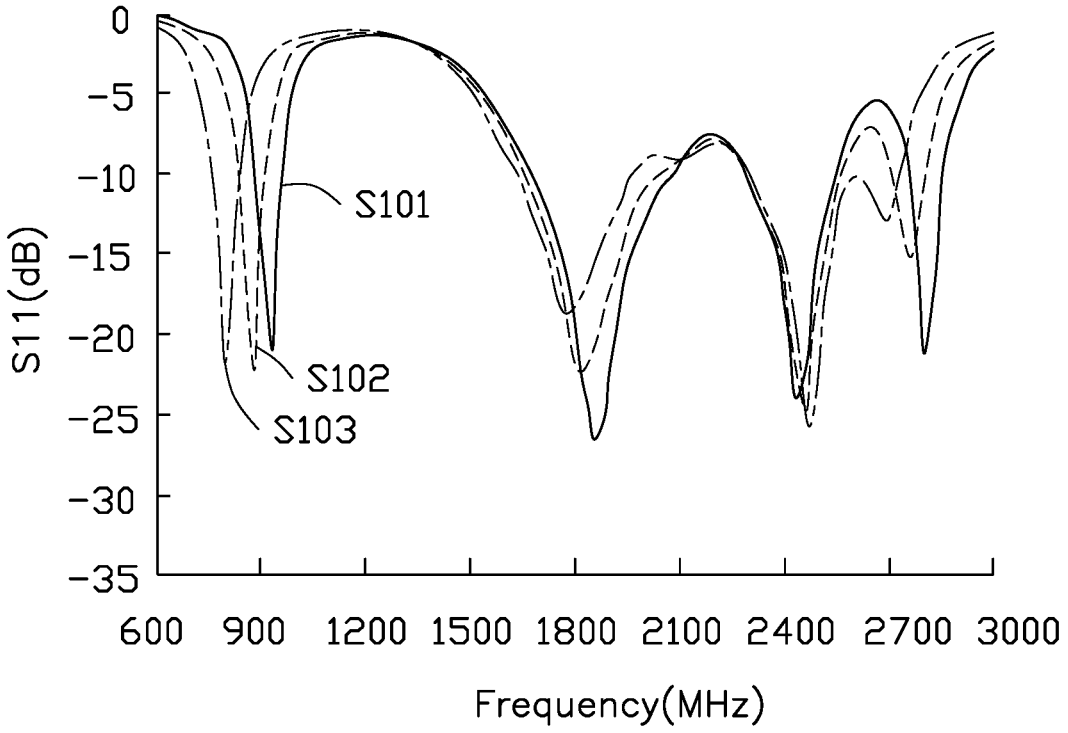
FIG. 10 is a graph of a scattering parameter S of the antenna structure in FIG. 4 when the switching circuit is switched to different switching elements.

FIG. 10 is a graph of the scattering parameter S of the antenna structure 100 in FIG. 4 when the switching circuit 17 is switched to different switching elements 173. The curve S101 indicates value of the scattering parameter S11 when the switching circuit 17 is switched to the switching element 173 having an inductance value of 20 nH. The curve S102 indicates value of the scattering parameter S11 when the switching circuit 17 is switched to the switching element 173 having an inductance value of 40 nH. The curve S103 indicates value of the scattering parameter S11 when the switching circuit 17 is switched to the floating state.

Figure 11:
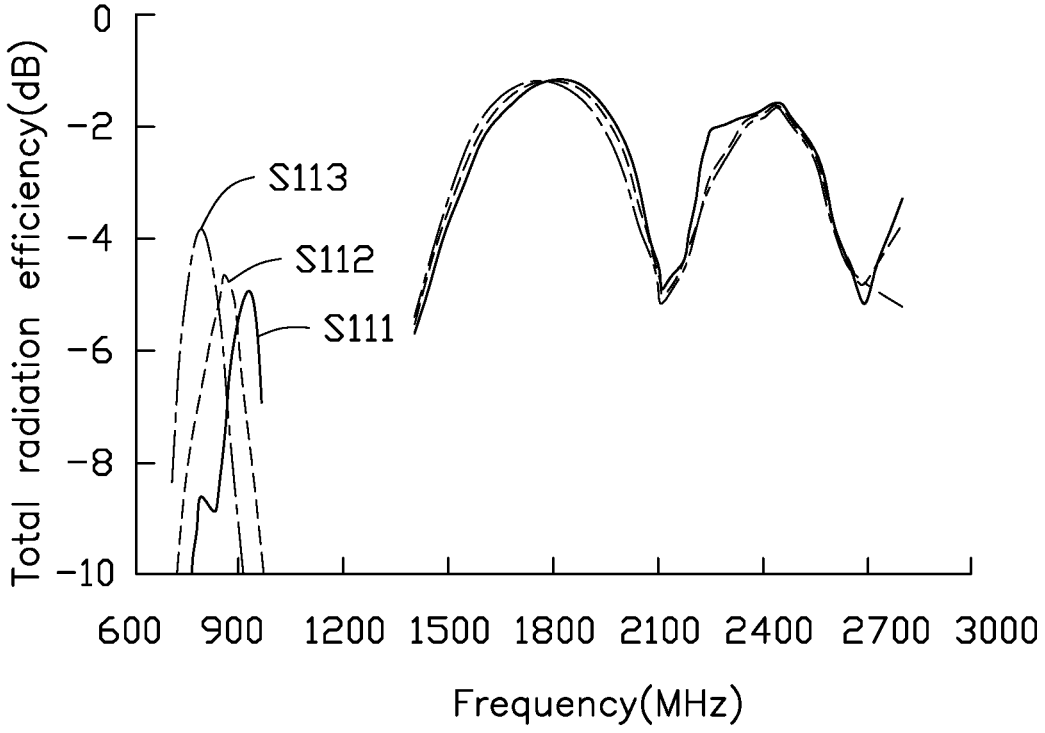
FIG. 11 is a graph showing a total radiation efficiency of the antenna structure in FIG. 4 when the switching circuit is switched to different switching elements.

FIG. 11 is a graph showing a total radiation efficiency of the antenna structure 100 in FIG. 4 when the switching circuit 17 is switched to different switching elements 173. The curve S111 indicates value of the total radiation efficiency of the antenna structure 100 when the switching circuit 17 is switched to the switching element 173 having an inductance value of 20 nH. The curve S112 indicates value of the total radiation efficiency of the antenna structure 100 when the switching circuit 17 is switched to the switching element 173 having an inductance value of 40 nH. The curve S113 indicates value of the total radiation efficiency of the antenna structure 100 when the switching circuit 17 is switched to the floating state.

FIGS. 10 and 11 illustrate that by setting the switching circuit 17, the low frequency of the antenna structure 100 can cover 700-960 MHz, with the value of the scattering parameter S11 is −5 dB. The antenna structure 100 has good efficiency, and its radiation efficiency is greater than −6 dB, which satisfies design requirements of the antenna. At the same time, the switching circuit 17 does not affect the bandwidth of the intermediate frequency and the high frequency of the antenna structure 100, which is suitable for carrier aggregation (CA).

Figure 12:
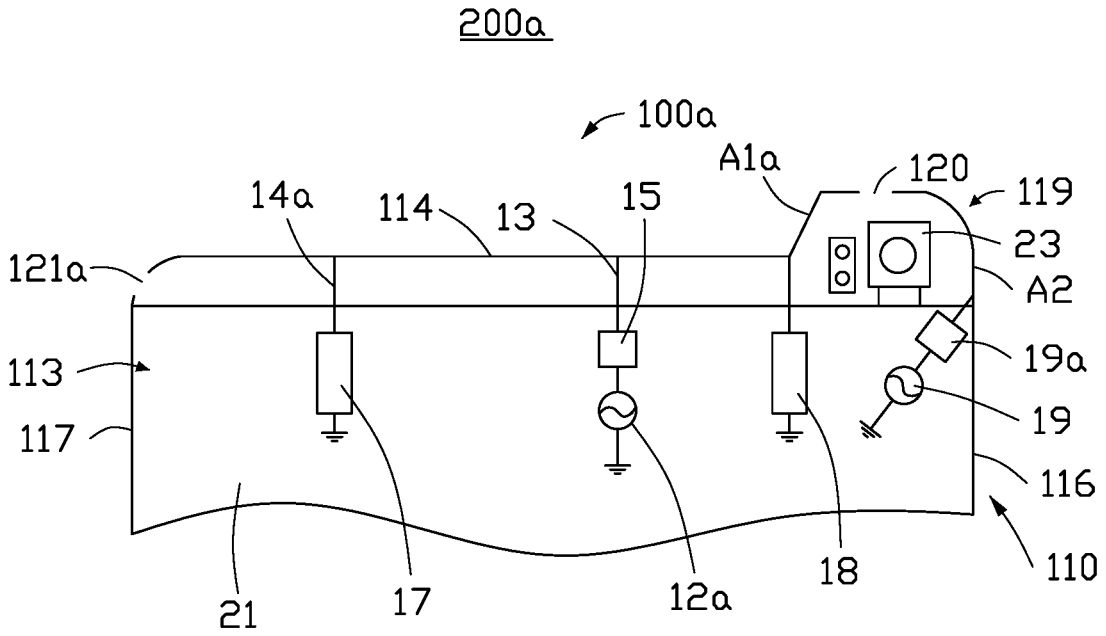
FIG. 12 is a schematic view of an antenna structure in a wireless communication device according to a second embodiment.

FIG. 12 shows an antenna structure 100*a* according to a second embodiment. The antenna structure 100*a* is adapted for a wireless communication device 200*a* such as a mobile phone or a personal digital assistant, for transmitting and receiving radio waves.

The antenna structure 100*a* includes a metal frame 110, a first feed source 12*a*, a connection portion 13, a ground portion 14*a*, a matching circuit 15, and a switching circuit 17. The wireless communication device 200*a* includes a substrate 21 and an electronic component 23. A protruding portion 119 protrudes from the metal frame 110. The metal frame 110 defines a first gap 120 and a second gap 121*a*. The electronic component 23 is disposed in the protruding portion 119.

In the embodiment, the position of the second gap 121*a* in the antenna structure 100*a* is different from the position of the second gap 121 in the antenna structure 100. In the embodiment, the second gap 121*a* is disposed at a junction of the first end portion 114 and the second side portion 117. Thus, the first gap 120 and the second gap 121*a* divide the metal frame 110 to a first radiation portion A1*a* and a second radiation portion A2. That is, in the embodiment, the antenna structure 100*a* includes only the first radiation portion A1*a* and the second radiation portion A2, the third radiation portion A3 is omitted. A part of the metal frame 110 between the first gap 120 and the second gap 121*a* forms the first radiation portion A1*a*. A part of the metal frame 110 extending from the first gap 120 to the first side portion 116 forms the second radiation portion A2.

In the embodiment, the position of the first feed source 12*a* and the position of the ground portion 14*a* in the antenna structure 100*a* are different. In the embodiment, the first feed source 12*a* is disposed adjacent to the first gap 120. One end of the first feed source 12*a* is electrically connected to a side of the first radiation portion A1*a* close to the first gap 120 through the matching circuit 15 and the connecting portion 13, and the other end of the first feed source 12*a* is grounded, for feeding current to the first radiation portion A1*a*. The ground portion 14*a* is spaced apart from the first feed source 12*a* and disposed between the first feed source 12*a* and the second gap 121*a*. One end of the ground portion 14*a* is electrically connected to the first radiation portion A1, and the other end of the ground portion 14*a* is grounded through the switching circuit 17 for the first radiation portion A1*a* to be grounded.

In the embodiment, the antenna structure 100*a* is different in that the antenna structure 100*a* further includes a loading circuit 18, a second feed source 19, and a matching unit 19*a*. The loading circuit 18 is disposed in the accommodating space 113. The loading circuit 18 can include an inductor, a capacitor, or a combination thereof. The loading circuit 18 is disposed between the first gap 120 and the first feed source 12*a*. One end of the loading circuit 18 is electrically connected to the first radiation portion A1*a*, and the other end of the loading circuit 18 is grounded.

The second feed source 19 and the matching unit 19 a are disposed between the first gap 120 and the first side portion 116, and disposed adjacent to the first side portion 116. One end of the second feed source 19 is electrically connected to the second radiation portion A2 through the matching unit 19*a*, and the other end of the second feed source 19 is grounded.

In another embodiment, the position of the second gap 121*a* on the metal frame 110 in the antenna structure 100*a* can be as needed. For example, the second gap 121*a* can be adjusted toward the position of the first gap 120. Thus, the antenna structure 100*a* may still include the third radiation portion A3. That is, a part of the metal frame 110 extending from the second gap 121*a* to the second side portion 117 forms the third radiation portion A3.

Figure 13:
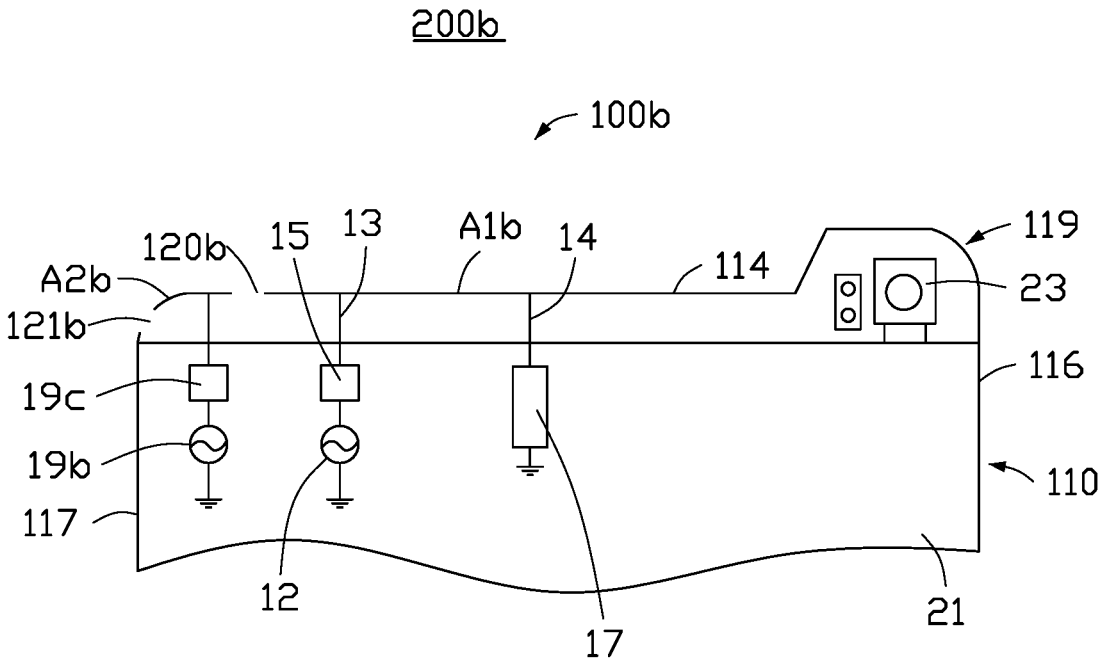
FIG. 13 is a schematic view of an antenna structure in a wireless communication device according to a third embodiment.

FIG. 13 is an antenna structure 100*b* according to a third embodiment. The antenna structure 100*b* is adapted for a wireless communication device 200*b* such as a mobile phone or a personal digital assistant.

The antenna structure 100*b* includes a metal frame 110, a first feed source 12, a connection portion 13, a ground portion 14, a matching circuit 15, and a switching circuit 17. The wireless communication device 200*b* includes a substrate 21 and an electronic component 23. A protruding portion 119 protrudes from the metal frame 110. The metal frame 110 defines a first gap 120*b* and a second gap 121*b*. The electronic component 23 is disposed in the protruding portion 119.

In the embodiment, the position of the first gap 120*b* and the position of the second gap 121*b* in the antenna structure 100*b* are different. In the embodiment, the first gap 120*b* is not disposed on the protruding portion 119, but is disposed at a position where the first end portion 114 is close to the second side portion 117. The second gap 121*b* is disposed at a junction of the first end portion 114 and the second side portion 117. Thus, the first gap 120*b* and the second gap 121*b* divide the metal frame 110 to a first radiation portion A1*b* and a second radiation portion A2*b*. That is, the antenna structure 100*b* includes only the first radiation portion A1*b* and the second radiation portion A2*b*, the third radiation portion A3 is omitted. A part of the metal frame 110 extending from the first gap 120*b* to the first side portion 116 forms the first radiation portion A1*b*. A part of the metal frame 110 between the first gap 120*b* and the second gap 121*b* forms the second radiation portion A2*b*.

In the embodiment, one end of the first feed source 12 is electrically connected to a side of the first radiation portion A1*b* close to the first gap 120*b* through the matching circuit 15 and the connecting portion 13, and the other end of the first feed source 12 is grounded, for feeding a current to the first radiation portion A1*b*. The ground portion 14 is spaced apart from the first feed source 12. The ground portion 14 is disposed on a side of the first feed source 12 away from the first gap 120*b*. One end of the ground portion 14 is electrically connected to the first radiation portion A1*b*, and the other end of the ground portion 14 is grounded through the switching circuit 17 for the first radiation portion A1*b* to be grounded.

In the embodiment, the antenna structure 100*b* is different from the antenna structure 100 in that the antenna structure 100*b* further includes a second feed source 19*b* and a matching unit 19*c*. The second feed source 19*b* is disposed in the metal frame 110 and is positioned between the first gap 120*b* and the second gap 121*b*. One end of the second feed source 19*b* is electrically connected to the second radiation portion A2*b* through the matching unit 19*c*, and the other end of the second feed source 19*b* is grounded.

In the embodiment, the first feed source 12 and the first radiation portion A1*b* together constitute a loop antenna. The second feed source 19*b*, the matching unit 19*c*, and the second radiation portion A2*b* collectively constitute a monopole antenna. A gap formed between the first radiation portion A1*b* and the substrate 21 has a capacitance. Therefore, a corresponding slot antenna can be formed.

The antenna structures 100/100*a*/100*b* and the wireless communication devices 200/200*a*/200*b* having the antenna structures 100/100*a*/100*b* provide protrusions 119 on the metal frame 110. Thee protrusions 119 can be configured to receive the electronic component 23. The display unit 201 can form a complete display plane 202. That is, the display plane 202 can be a complete rectangle. The display plane 202 does not need to define a gap for receiving the electronic component. In addition, under the display plane 202 of complete rectangle, it is not necessary to compress the clearance area 211 of the antenna structures 100/100*a*/100*b*.

The embodiments shown and described above are only examples. Therefore, many commonly-known features and details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will, therefore, be appreciated that the embodiments described above may be modified within the scope of the claims.

What is claimed is:

1. An antenna structure comprising:

a metal frame;

a protruding portion protruded from a side of the metal frame; and at least one feed source;

wherein the side of the metal frame protruding the protruding portion defines a first gap and a second gap, the first gap and the second gap divide the metal frame to at least two radiation portions, the at least one feed source is electrically connected to each of the at least two radiation portions and feeds a current to each of the at least two radiation portions, the metal frame comprises a first end portion, a second end portion, a first side portion and a second side portion, the first end portion is disposed opposite to the second end portion, each of the first side portion and the second side portion is disposed at each opposite end of the first end portion and the second end portion, the protruding portion is disposed on a side of the first end portion adjacent to the first side portion and extends in a direction away from the second end portion, the protruding portion defines the first gap, the first gap and the second gap divide the metal frame to a first radiation portion and a second radiation portion.

2. The antenna structure of claim 1, wherein the at least one feed source comprises a first feed source, the antenna structure further comprises a ground portion, the first feed source is electrically connected to the first radiation portion and feeds the current to the first radiation portion, another end of the first feed source is grounded, the current flowing through the first radiation portion couples to the second radiation portion through the first gap.

3. The antenna structure of claim 2, wherein the second gap is disposed on a side of the first end portion adjacent to the second side portion, and the second gap divides the metal frame to a third radiation portion, the first radiation portion is positioned between the first gap and the second gap, a part of the metal frame extending from the first gap to the first side portion forms the second radiation portion, a portion of the metal frame extending from the second gap to the second side portion forms the third radiation portion, the current flowing through the first radiation portion couples to the third radiation portion through the second gap.

4. The antenna structure of claim 2, wherein the antenna structure further includes a switching circuit, the switching circuit comprises a switching unit and a plurality of switching elements, the switching unit is electrically connected to the ground portion and is electrically connected to the first radiation portion through the ground portion, the plurality of the switching elements are connected in parallel with each other, and one end of the each of the switching elements is electrically connected to the switching unit, and another end of each of the switching elements is grounded, by controlling switching of the switching unit, the first radiation portion is adapted to be switched to different switching elements and to adjust a frequency of a radiation band of the antenna structure.

5. A wireless communication device comprising:

an antenna structure comprising:

a metal frame made of a metallic material and comprising a protruding portion protruded from a side of the metal frame; and at least one feed source;

wherein the side of the metal frame positioned the protruding portion defines a first gap and a second gap, the first gap and the second gap divide the metal frame to at least two radiation portions, the at least one feed source is electrically connected to each of the at least two radiation portions and feeds a current to each of the at least two radiation portions, wherein the metal frame comprises a first end portion, a second end portion, a first side portion and a second side portion, the first end portion is disposed opposite to the second end portion, each of the first side portion and the second side portion is disposed at each opposite end of the first end portion and the second end portion, the protruding portion is disposed on a side of the first end portion adjacent to the first side portion and extends in a direction away from the second end portion, the protruding portion defines the first gap, the first gap and the second gap divide the metal frame to a first radiation portion and a second radiation portion.

6. The wireless communication device of claim 5, further comprises:

a display unit comprising a complete unnotched display plane and being received in the metal frame; and an optical module received in the protruding portion.

7. The wireless communication device of claim 5, wherein the at least one feed source comprises a first feed source, the antenna structure further comprises a ground portion, the first feed source is electrically connected to the first radiation portion and feeds the current to the first radiation portion, another end of the first feed source is grounded, the current flowing through the first radiation portion couples to the second radiation portion through the first gap.

8. The wireless communication device of claim 7, wherein the second gap is disposed on a side of the first end portion adjacent to the second side portion, and the second gap divides the metal frame to a third radiation portion, the first radiation portion is positioned between the first gap and the second gap, a part of the metal frame extending from the first gap to the first side portion forms the second radiation portion, a portion of the metal frame extending from the second gap to the second side portion forms the third radiation portion, the current flowing through the first radiation portion couples to the third radiation portion through the second gap.

* * * * *